US007694496B2

(12) United States Patent
Keiger et al.

(10) Patent No.: US 7,694,496 B2
(45) Date of Patent: Apr. 13, 2010

(54) RETENTION PACKAGING HAVING FILM WITH PLEATED PORTION

(75) Inventors: Stephen A. Keiger, Copley, OH (US); Richard Anderson, Massillon, OH (US)

(73) Assignee: KPC-Master's Craft International, Inc., Massillon, OH (US)

( * ) Notice: Subject to any disclaimer, the term of this patent is extended or adjusted under 35 U.S.C. 154(b) by 13 days.

(21) Appl. No.: 12/104,436

(22) Filed: Apr. 17, 2008

(65) Prior Publication Data

US 2009/0242449 A1 Oct. 1, 2009

Related U.S. Application Data

(60) Provisional application No. 61/041,569, filed on Apr. 1, 2008.

(51) Int. Cl.
*B65B 43/08* (2006.01)
*B65B 53/00* (2006.01)

(52) U.S. Cl. ..... 53/456; 53/441

(58) Field of Classification Search ..... 53/456, 53/441, 465

See application file for complete search history.

(56) References Cited

U.S. PATENT DOCUMENTS 5,033,252 A * 7/1991 Carter ..... 53/425
6,148,590 A * 11/2000 Ridgeway et al. ..... 53/449
6,675,973 B1 * 1/2004 McDonald et al. ..... 206/583

* cited by examiner

*Primary Examiner*—Rinaldi I. Rada
*Assistant Examiner*—John Paradiso
(74) *Attorney, Agent, or Firm*—Tillman Wright, PLLC; Chad D. Tillman; Jeremy C. Doerre

(57) ABSTRACT

A retention packaging includes a support member having first and second sections each defining a support surface for receiving an object thereon for shipping, and a film disposed in covering relation to the support surfaces of the support member and retained to the support member at the first and second sections. The first and second sections are pivotably connected to one another along a fold line that transects the support member. The film includes opposite ends each enclosing a respective opposite end of the support member and defining overlapping areas of the film that are permanently joined together, and a pleated portion that is located between the opposite ends of the film and that includes at least one fold in the film. The film is removably secured to itself so as to removably secure the at least one fold of the pleated portion.

20 Claims, 6 Drawing Sheets

RETENTION PACKAGING HAVING FILM WITH PLEATED PORTION

CROSS-REFERENCE TO RELATED APPLICATION

The present application is a U.S. nonprovisional patent application of, and claims priority under 35 U.S.C. §119(e) to, U.S. Provisional Patent Application No. 61/041,569, filed Apr. 1, 2008, which provisional patent application is incorporated herein by reference.

INCORPORATION BY REFERENCE

The present application further incorporates herein by reference the following:

a) Keiger, U.S. patent application Ser. No. 11/941,061, filed Nov. 15, 2007, and Keiger, U.S. Patent Application Publication No. 2008/0110788, which represents the publication of the '061 application to Keiger;

b) Anderson, et al., U.S. patent application Ser. No. 11/941,067, filed Nov. 15, 2007, and Anderson et al., U.S. Patent Application Publication No. 2008/0110794, which represents the publication of the '067 application to Anderson et al.; and c) Keiger, U.S. Provisional Patent Application No. 60/865,847, filed Nov. 15, 2006.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to packaging materials, and particularly to a retention packaging for securely holding an object to be packaged against a backing.

Retention packaging designs are well known. A typical retention packaging includes a rigid platform or backing against which an object is held and a pliable film that covers the object and that is tensioned in order to securely hold the object against the backing. Known retention packaging designs are disclosed, for example, in U.S. Pat. No. 6,675,973 to McDonald et al. ("McDonald") and U.S. Pat. No. 6,010,003 to Wilkinson ("Wilkinson"), each of which is hereby incorporated herein by reference.

In this respect, McDonald discloses a retention packaging that includes a backing having end flaps and a middle portion. An object is supported on the middle portion of the backing and a pliable film is extended over the object. The film furthermore includes pockets at opposite ends thereof that surround and enclose the end flaps of the backing. When the end flaps are folded down in a direction away from the object, the film is tensioned and stretched over the object and, thereby, retains the object against the middle portion of the backing. A stated benefit of the retention packaging of McDonald is that the film and the backing may be separately manufactured at different facilities geographically distant from one another and then shipped to and assembled at a common location by simply inserting the end flaps of the backing into the pockets formed in the ends of the film.

In contrast to McDonald, Wilkinson discloses a retention packaging that includes a backing and a pliable film that extends between opposite ends of the backing. The film is folded over and affixed to the rear of each of the opposite ends of the backing. When the backing is folded, the film is stretched over an object placed between the backing and the film, and the object is thereby suspended on the backing by the tensioned film.

While the retention packaging of McDonald and the retention packaging of Wilkinson are fit for their intended purposes, an improved retention packaging and method of manufacture nevertheless are desirable. In particular, a need exists for a retention packaging that is capable of securely holding tall, large, or bulky objects in a sturdy manner so as to protect such objects during shipping or transportation. Furthermore, a need exists for a simple and reliable method of manufacturing such a retention packaging. These, and other needs, are addressed by one or more aspects of the present invention.

SUMMARY OF THE INVENTION

The present invention includes many aspects and features. Moreover, while many aspects and features relate to, and are described in, the context of a retention packaging, the present invention is not limited to use only in connection with a retention packaging, as will become apparent from the following summaries and detailed descriptions of aspects, features, and one or more embodiments of the present invention.

Accordingly, one aspect of the present invention relates to a retention packaging. An exemplary such retention packaging includes a support member having first and second sections each defining a support surface for receiving an object thereon for shipping, and a film disposed in covering relation to the support surfaces of the support member and retained to the support member at the first and second sections. Furthermore, in this aspect of the invention, the first and second sections are pivotably connected to one another along a fold line that transects the support member. The file includes opposite ends each enclosing a respective opposite end of the support member and defining overlapping areas of the film that are permanently joined together, with the first section of the support member extending between the overlapping areas of one of the opposite ends of the film, and with the second section of the support member extending between the overlapping areas of the other of the opposite ends of the film. Still yet in this aspect, each opposite end of the support member includes a respective opposite end edge of the support member. The opposite end edges of the support member are spaced a distance apart when the first and second sections are coplanar. The film further includes a pleated portion that is located between the opposite ends of the film and that includes at least one fold in the film. The film is removably secured to itself so as to removably secure the at least one fold of the pleated portion. An unfolded length of the film may exceed the distance between the opposite end edges of the support member without compromising the retention of the film to the support member.

In variations of this aspect, the fold line may generally bisect the support member; the film may be retained to the support member only by extension of the first and second sections of the support member between the overlapping areas of the film; the first and second sections of the support member may be approximately equal in length and width; the first and second sections of the support member may have approximately equal surface area; the overlapping areas of the film that are permanently joined together may be heat sealed, adhered, or welded together; the film may include a stretchable material; the film may include a heat shrinkable material; the support member may be scored along the fold line; and the support member may include a rigid material.

In a feature of this aspect of the invention, the film further may include a plurality of tabs located along a side edge of the film and spaced to substantially coincide with one another by virtue of the at least one fold in the film. In accordance with this aspect, the tabs may be removably attached to one another to removably secure the at least one fold of the pleated portion. Furthermore, the plurality of tabs may be adhered together to removably secure the at least one fold of the pleated portion. Alternatively, the plurality of tabs may be sealed together to removably secure the at least one fold of the pleated portion.

Another aspect of the invention relates to a shipping apparatus. An exemplary such shipping apparatus includes a shipping container having an interior cargo space defined by a length, a height, and a width; and a retention packaging contained within the shipping container. The retention packaging includes a support member having first and second sections each defining a support surface for receiving an object thereon for shipping, and a film disposed in covering relation to the support surfaces of the support member and retained to the support member at the first and second sections. The first and second sections are pivotably connected to one another along a fold line that transects the support member. The film includes opposite ends each enclosing a respective opposite end of the support member and defining overlapping areas of the film that are permanently joined together, with the first section of the support member extending between the overlapping areas of one of the opposite ends of the film, and with the second section of the support member extending between the overlapping areas of the other of the opposite ends of the film. Furthermore, in this aspect of the invention, each opposite end of the support member includes a respective opposite end edge of the support member. The opposite end edges of the support member are spaced a distance apart when the first and second sections are coplanar. The film further includes a pleated portion that is located between the opposite ends of the film and that includes at least one fold in the film. The film is removably secured to itself so as to removably secure the at least one fold of the pleated portion. The film further includes a plurality of tabs located along a side edge of the film and spaced to substantially coincide with one another by virtue of the at least one fold in the film. The tabs are removably attached to one another to removably secure the at least one fold of the pleated portion. Still yet in this aspect, an unfolded length of the film may exceed the distance between the opposite end edges of the support member without compromising the retention of the film to the support member.

In variations of this aspect, the fold line may generally bisect the support member, the first and second sections of the support member may be approximately equal in length and width, and the equal lengths and widths of the first and second sections of the support member may be generally the same as the length and width of the interior cargo space of the shipping container. Furthermore, in accordance with this aspect, the film with the pleated portion may be retained to the support member only by extension of the first and second sections of the support member between the overlapping areas of the film; the overlapping areas of the film that are permanently joined together may be heat sealed, adhered, or welded together; and the film may include a stretchable material.

Another aspect of the invention relates to a method of preparing a shipping container. An exemplary such method includes providing a retention packaging that includes a support member having first and second sections each defining a support surface for receiving an object thereon for shipping, and a film disposed in covering relation to the support surfaces of the support member and retained to the support member at the first and second sections. The first and second sections are pivotably connected to one another along a fold line that transects the support member. The film includes opposite ends each enclosing a respective opposite end of the support member and defining overlapping areas of the film that are permanently joined together, with the first section of the support member extending between the overlapping areas of one of the opposite ends of the film, and with the second section of the support member extending between the overlapping areas of the other of the opposite ends of the film. Each opposite end of the support member includes a respective opposite end edge of the support member. The opposite end edges of the support member are spaced a distance apart when the first and second sections are coplanar. The film further includes a pleated portion that is located between the opposite ends of the film and that includes at least one fold in the film. The film is removably secured to itself so as to removably secure the at least one fold of the pleated portion. The film further includes a plurality of tabs located along a side edge of the film and spaced to substantially coincide with one another by virtue of the at least one fold in the film. The tabs are removably attached to one another to removably secure the at least one fold of the pleated portion.

In accordance with this aspect, the method further includes separating the tabs from one another so as to unsecure the at least one fold and thereby open the pleated portion of the film; placing an object on the support surface of a selected one of the first and second sections of the support member such that the film extends over the object; pivoting one of the sections relative to the other section about the fold line so that the first and second sections of the support member are disposed in substantially overlapping, abutting relation to one another such that the film tensions the object in abutment with the selected support surface; and placing the retention packaging into an interior cargo space of the shipping container.

In variations of this aspect, a height of the object from the selected support surface may exceed both a length and a width of the selected support surface. Additionally, the height of the object from the selected support surface may exceed twice the length and twice the width of the selected support surface.

Another aspect of the invention relates to a method of making a retention packaging. An exemplary such method includes positioning both a film and a support member such that the film extends, in covering relation to a surface of the support member, beyond a first side edge of the support member, beyond a second side edge of the support member, and beyond opposite end edges of the support member; folding opposite end edges of the film such that the film forms first overlapping areas beyond and proximate the first side edge of the support member at the opposite end edges of the support member, and forms second overlapping areas beyond and proximate the second side edge of the support member at the opposite end edges of the support member; and permanently joining the first overlapping areas of the film together and permanently joining the second overlapping areas of the film together. The method further includes creating at least one fold in the film between the opposite end edges of the film and removably securing the film to itself so as to removably secure the at least one fold in the film, thereby defining a pleated portion of the film. An unfolded length of the film may exceed a distance between the opposite end edges of the support member. Furthermore, in this aspect of the invention, the film with the pleated portion is retained to the support member by the opposite end edges of the film that are folded over the opposite end edges of the support member and the permanently joined overlapping areas of the film that are beyond and proximate the first and second side edges of the support member.

In variations of this aspect, the method may further include cutting the film proximate the first overlapping areas and proximate the second overlapping areas.

Still another aspect of the invention relates to a method of making first and second retention packagings via an assembly line. An exemplary such method includes, for each of the first and second retention packagings, positioning both a film and a support member such that the film extends, in covering relation to a surface of the support member, beyond a leading edge of the support member, beyond a trailing edge of the support member, and beyond opposite side edges of the support member; folding opposite side edges of the film such that the film forms first overlapping areas proximate and beyond the leading edge of the support member; permanently joining the first overlapping areas of the film together; cutting the film proximate the first overlapping areas; folding opposite side edges of the film such that the film forms second overlapping areas proximate and beyond the trailing edge of the support member; permanently joining the second overlapping areas of the film together; and cutting the film proximate the second overlapping areas.

Furthermore, in this aspect of the invention, the film is retained to the support member by opposite side edges of the film that are folded over the opposite side edges of the support member and the permanently joined overlapping areas of the film that are proximate and beyond the leading and trailing edges of the support member. Still yet in this aspect, the step of cutting the film at the second overlapping areas with regard to the first retention packaging is performed concurrently with the step of cutting the film at the first overlapping areas with regard to the second retention packaging. The method further includes forming a pleated portion in the film of each of the first and second retention packagings by creating at least one fold in the film between opposite side edges of the support member and removably securing the film to itself so as to removably secure the at least one fold in the film.

In addition to the aforementioned aspects and features of the present invention, it should be noted that the present invention further encompasses the various possible combinations of such aspects and features.

BRIEF DESCRIPTION OF THE DRAWINGS

One or more preferred embodiments of the present invention now will be described in detail with reference to the accompanying drawings, wherein the same elements are referred to with the same reference numerals, and wherein.

DETAILED DESCRIPTION

Figure 1:
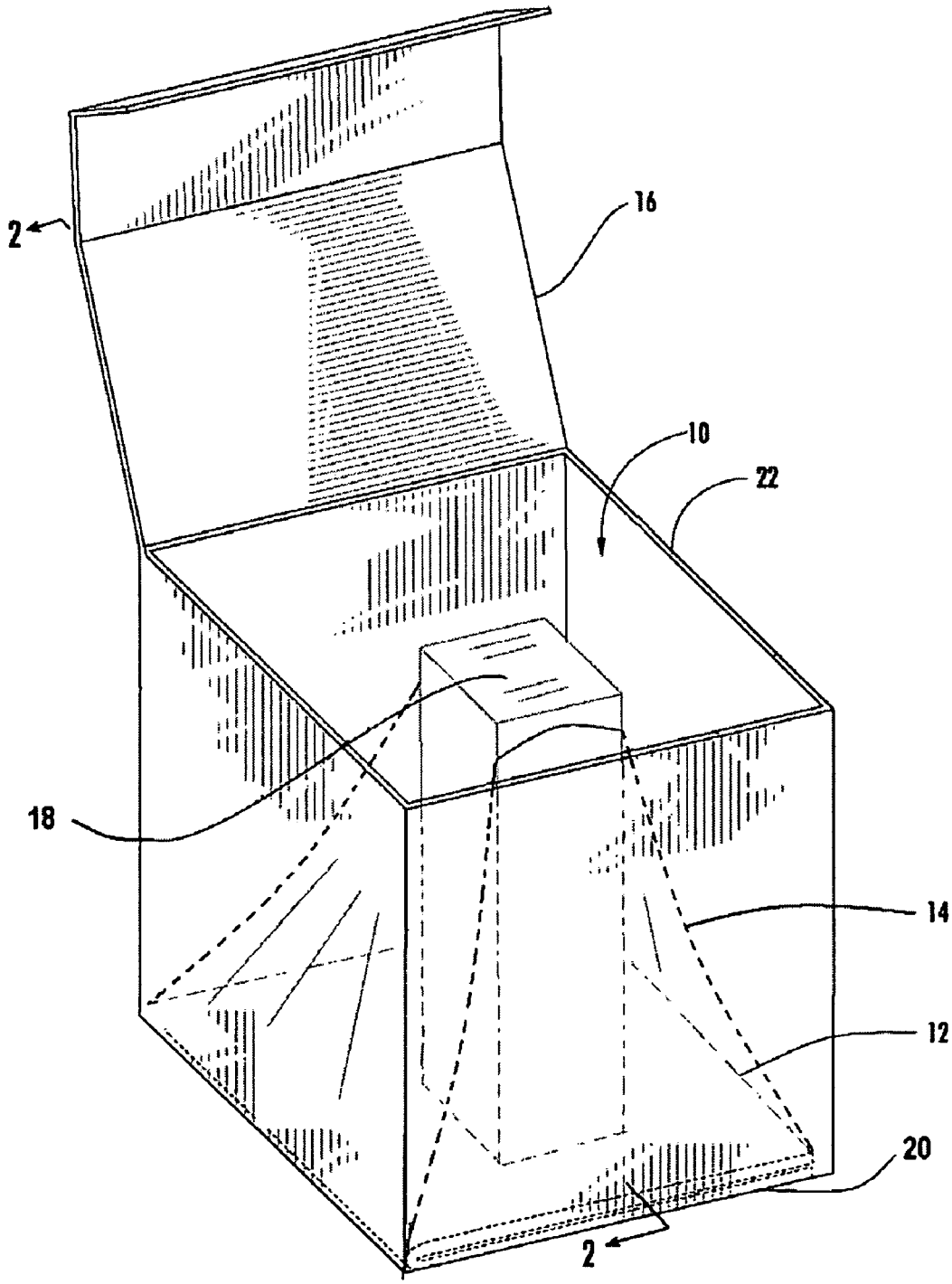
FIG. 1 is a perspective view of a shipping container including a box containing a retention packaging in accordance with a preferred embodiment of the present invention, wherein the retention packaging retains an object for shipment.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

Figure 2:
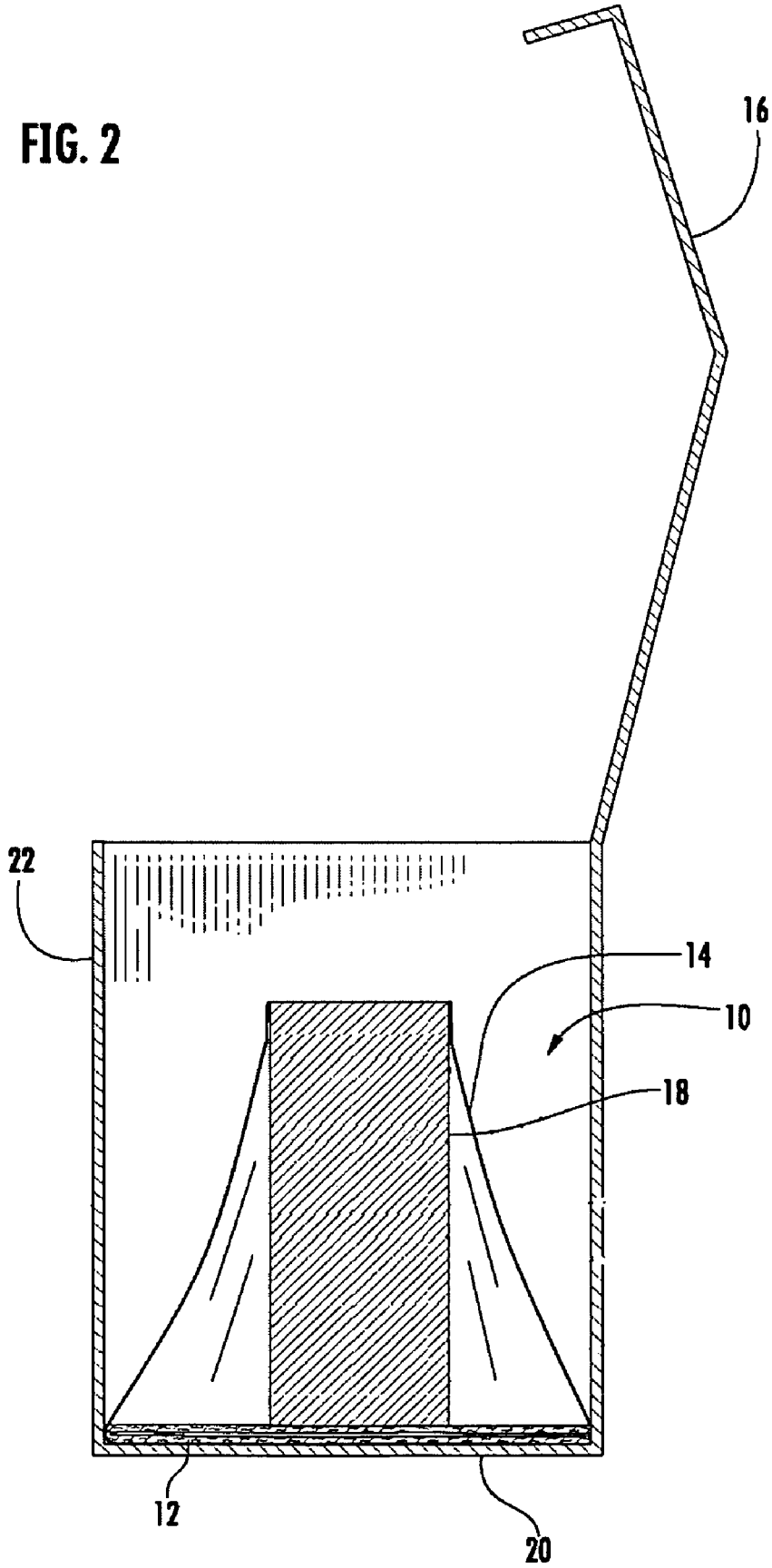
FIG. 2 is a side cross-sectional view of the box and retention packaging of FIG. 1 taken along the line 2-2.

FIGS. 1 and 2 illustrate a retention packaging 10 disposed in a shipping container for transport. For purposes of illustration, the shipping container is illustrated in the form factor of a box 16. The retention packaging 10 retains an object 18 having a tall, large, or bulky shape from movement within the box 16 during transport in order to avoid jostling of, and possible damage to, the object 16. More particularly, FIG. 1 is a perspective view of a box 16 containing a retention packaging 10 in accordance with a first preferred embodiment of the present invention. FIG. 2 is a side, cross-sectional view of the box 16 and retention packaging 10 taken along the line 2-2 of FIG. 1.

The retention packaging 10 includes a support member 12 and a film 14. As shown in FIGS. 1 and 2, the retention packaging 10 is disposed in a shipping configuration, which is described in greater detail below. However, it will be noted that, when in the shipping configuration, the film 14 of the retention packaging 10 is stretched over the object 18 and is tensioned so as to inhibit movement of the object 18 during transport of the box 16. The Ordinary Artisan will understand that the film 14 may be formed from any suitable plastic film material. Examples include polypropylene, PVC, linear low density polyethylene, or hybrid biaxially oriented shrink film. Further, the film 14 may have a memory characteristic such that when the object 18 is removed from the retention packaging 10, the film 14 will retain an impression therein of the object 18 so that the object 18—or an object having a similar shape—may then be placed in the retention packaging 10 for subsequent transport, with the film 14 corresponding to the shape of the object for a shape-conforming fit of the object.

It also is contemplated that the film 14 further may be heat shrunk over the object 18 prior to the retention packaging 10 being placed into the box 16 (provided the film is heat shrinkable). The heating shrinking would be performed according to conventional heat shrinking methods and, therefore, a detailed description of such heat shrinking is not included herein.

Typically, once a tall, large, or bulky object 18 to be shipped has been placed in the retention packaging 10 and the retention packaging 10 has been arranged in the shipping configuration, the retention packaging 10 is placed in the box 16, with the support member 12 resting against a base 20 of the box 16. The film 14 of the retention packaging 10 holds the object 18 against the support member 12 and suspends the object 18 away from walls 22 of the box 16 so that the object 18 does not collide with the walls 22 of the box 16 during transport. The support member 12 of the retention packaging 10 also provides a buffer between the object 18 and the base 20 of the box 16. An additional buffer (not shown) also may be provided on top of the retention packaging 10 to secure the retention packaging 10 in its abutment with the base 20 of the box 16.

Figure 3A:
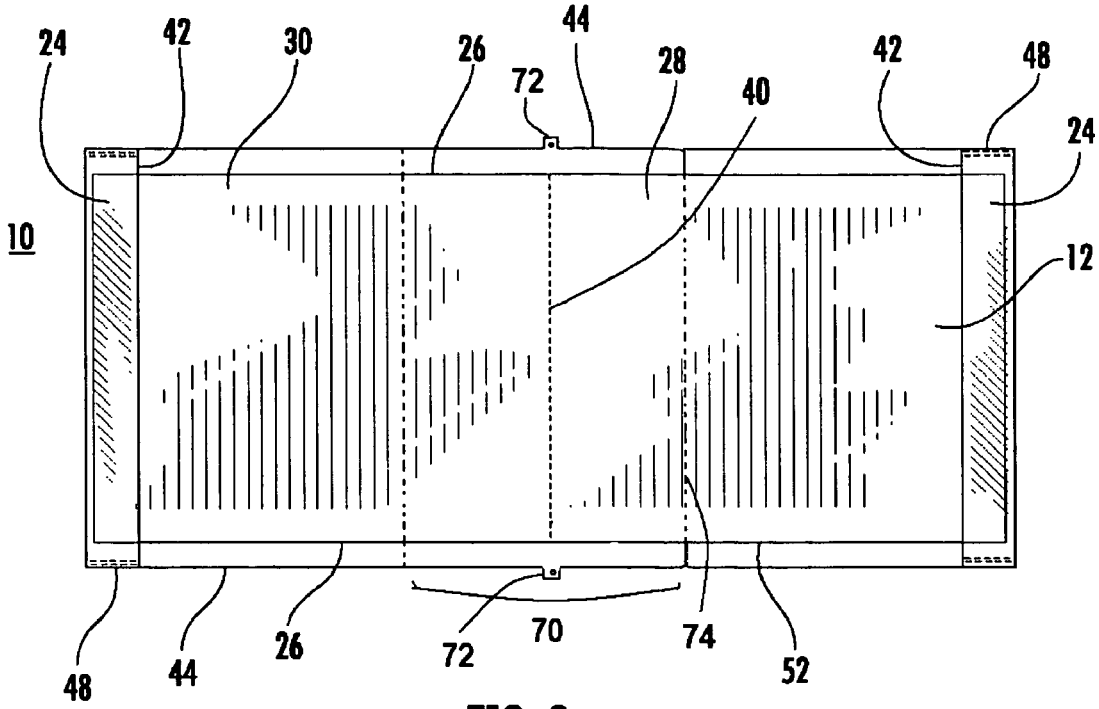
FIG. 3A is a bottom plan view of the retention packaging of FIG. 1, shown before the object has been loaded therein.
Figure 3B:
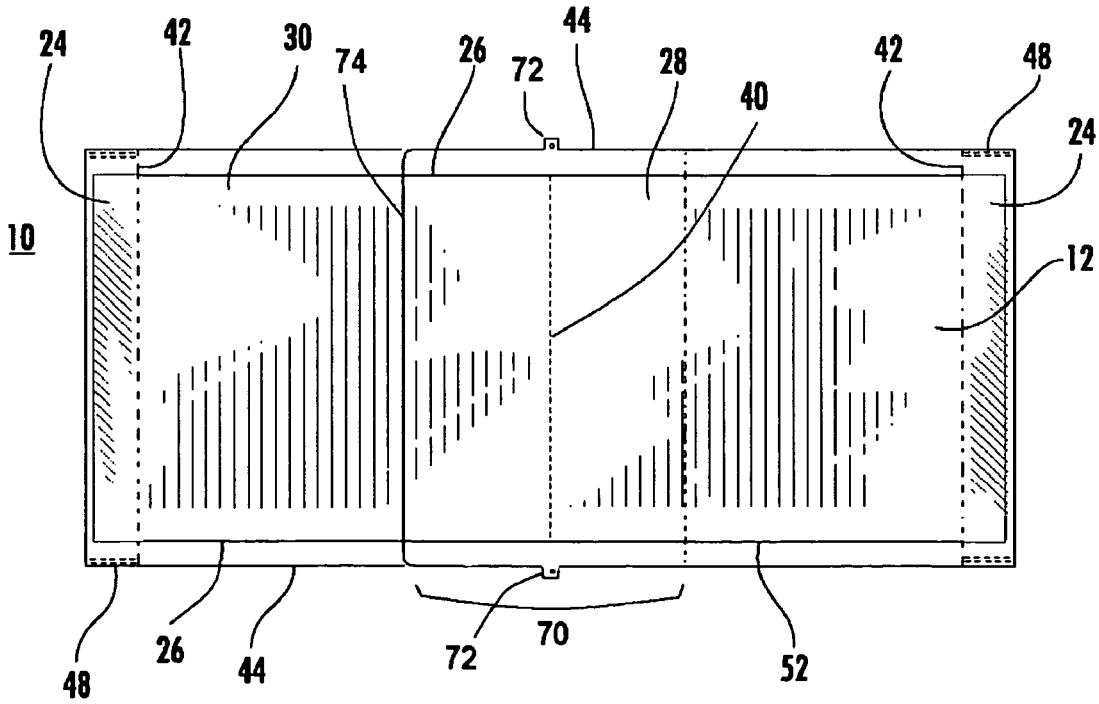
FIG. 3B is a top plan view of the retention packaging of FIG. 1, shown before the object has been loaded therein.
Figure 4:
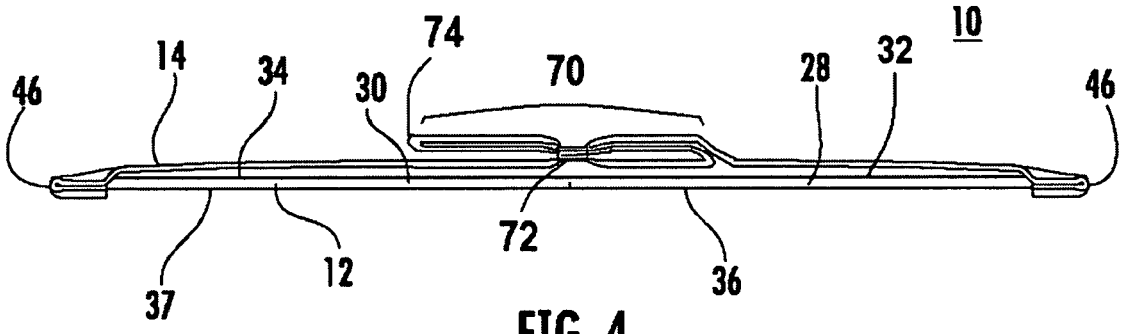
FIG. 4 is a side plan view of the retention packaging of FIG. 1, shown before the object has been loaded therein.

FIG. 3A and FIG. 3B are a bottom plan view and a top plan view, respectively, of the retention packaging 10 of FIG. 1 before the object 18 has been loaded therein. FIG. 4 is a side plan view of the retention packaging 10 of FIG. 1 before the object 18 has been loaded therein. As shown in FIGS. 3A, 3B, and 4, the support member 12 of the retention packaging 10 includes a quadrilateral perimeter having opposite ends 24 and sides 26. A fold line 40 transects the support member 12 and defines a first section 28 and a second section 30. Each section 28, 30 has, respectively, a top surface 32, 34 and a bottom surface 36, 37. The film 14 is disposed in covering relation to the top surfaces 32, 34 of the first and second sections 28, 30 of the support member 14, with the opposite ends 24 of the support member 12 extending within the receiving areas 46 of the film 14.

Described in more detail, the fold line 40 demarcates the first and second sections 28, 30 from each other and provides an axis of rotation for the first and second sections 28, 30 relative to one another. Preferably, the fold line 40 bisects the support member 12 such that the surface areas of the first section 28 and the second section 30 are approximately equal. The film 14 includes opposite ends 42 and sides 44. The film 14 is disposed in covering relation to the support member 12. More particularly, the film 14 extends in covering relation to the top surfaces 32, 34 of the first and second sections 28, 30 of the support member 12. The film 14 further extends beyond the ends 24 of the support member 12, and ends 42 of the film 14 respectively wrap around the ends 24 of the support member 12 and partially cover portions of the bottom surfaces 36, 37. The opposite ends 42 of the film 14 also are folded around the corresponding opposite ends 24 of the support member 12 such that folded portions of the film 14 define receiving areas 46 within which opposite ends 24 of the support member 12 are received and at least are partially enclosed. For each receiving area 46, overlapping areas comprising coinciding edges 48 of the portion of the film 14 forming the receiving area 46 are permanently jointed together to maintain the fold forming the receiving area 46. Various methods are available for permanently joining the edges 48 together. Examples include heat sealing, ultrasonic sealing, and use of various adhesives, such as glue. Furthermore, a discrete point or discrete points along the edges 48 may be permanently joined together or, alternatively, the entire edges 48 of the portions of the film 14 forming the receiving areas 46 may be permanently joined together.

As is further shown in FIGS. 3A, 3B, and 4, the film 14 has a pleated portion 70 located between the opposite ends 42 of the film 14. The pleated portion 70 includes at least one fold 74 whereby the film 14 is folded back upon itself. To form the pleat in the pleated portion 70, the portion of the film 14 that forms the fold 74 is secured to the remaining portion of the film 14 at tabs 72 located along side edges of the film 14. The tabs 72 may be spaced along side edges of the film 14 so as to substantially coincide with one another when the film 14 is folded back upon itself to form the fold 74 of the pleated portion 70. Tabs from each respective side of the film 14 may then be attached to one another to form the pleated portion 70. With the inclusion of the pleated portion 70 in the film 14, an unfolded length of the film 14 may exceed the distance between the outer edges of the ends 24 of the support member 12 without compromising the retention of the film 14 to the support member 12.

Preferably, tabs 72 are attached together in a removable manner so as to permit the pleat of the pleated portion 70 to be opened and the retention packaging 10 to be prepared for shipping. Upon opening the pleated portion 70, a large retaining space 50 is thereby defined between the film 14 and the support member 12 wherein a tall, large, or bulky object to be transported or shipped may be placed. The tabs 72 may be removably attached together by any means that might be preferred so as to permit the pleated portion 70 to be opened with relative ease when the retention packaging 10 is prepared for shipping. For instance, the tabs 72 may be attached together with an adhesive, or the tabs 72 may be sealed to one another. In particular, the tabs 72 may be sealed together with a tack seal.

Separating the tabs 72 and opening the pleated portion 70 provides a retaining space 50 between the film 14 and the support member 12 wherein a large, tall, or bulky object 18 to be transported or shipped may be placed. Horizontal planes of the first and second sections 28, 30 of the support member 12 are generally aligned when the retention packaging 10 is in this configuration, which results in relaxation of the film 14 compared to the shipping configuration. An object may be placed on either of the top surfaces 32, 34. Once an object 18 to be shipped is inserted into the retaining space 50 and placed on the top surface of one of the two sections 28, 30 of the support member 12, the section of the support member 12 that is not supporting the object 18 is rotated away from the object 18. Consequently, it is preferred that the object 18 not overlap a perimeter 52 of the section of the support member 12 on which it is placed.

In loading a large, tall, or bulky object 18 in the retention packaging 10, the tabs 72 on either side of the pleated portion 70 are separated from one another to open the pleated portion. Opening of the pleated portion 70 prior to loading permits the film 14 to be particularly loose in order to accommodate the greater size or bulk associated with larger objects. One of the sections 28, 30 is pivoted upwardly about fold line 40 relative to the other section, thereby further loosening the film 14 and forming an insertion pocket for easy loading of the object 18 onto one of the top surfaces 32,34. In pivoting one of the sections 28, 30 upwardly, the first and second sections 28, 30 may tend to form an "L" or "V" shaped configuration. Once the object 18 is loaded onto a top surface of one of the sections 28, 30, the other section is then pivoted downwardly about fold line 40 relative to the section supporting the object 18, which begins to tension and tighten the film 14 about the object 18.

Figure 5A:
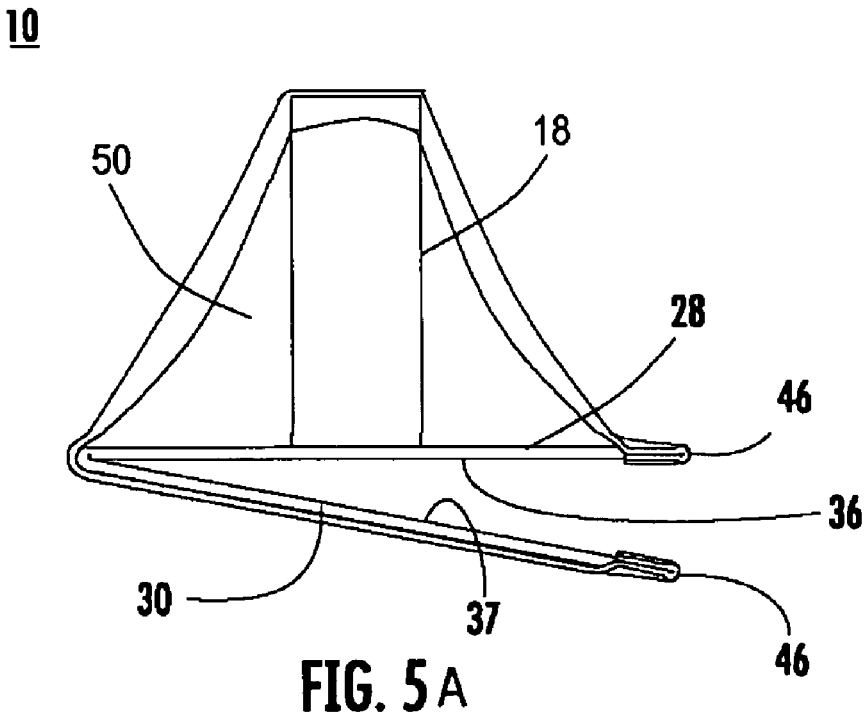
FIG. 5A is a side plan view of the retention packaging of FIG. 1, with an object placed therein and the support member partially folded about the fold line.
Figure 5B:
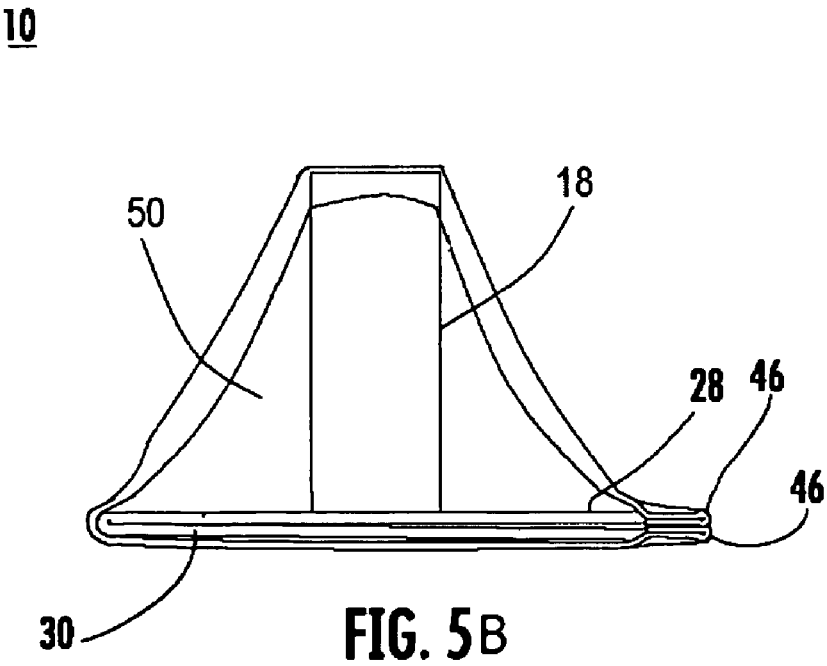
FIG. 5B is a side plan view of the retention packaging and object of FIG. 1 in a shipping configuration.

FIGS. 5A and 5B illustrate the tensioning of the film as this pivoting action transitions the retention packaging 10 to the shipping configuration. In particular, FIG. 5A is a side plan view of the retention packaging 10, with the large, tall, or bulky object 18 placed therein during transitioning to the shipping configuration. For exemplary purposes, the object 18 is shown in FIG. 5A as having been placed upon—and is being supported by—the first section 28. Accordingly, with continuing reference to FIG. 5A, the second section 30 is rotated about the fold line 40 downwardly and away from the object 18 and the support surface of the first section 28. As the second section 30 is folded away from the object 18, the film 14 is tensioned and stretched over the object 18. With the unfolded length of the film 14 exceeding the distance between the outer edges of the ends 24 of the support member 12, the film 14 is more ably suited to accommodate and secure the large, tall, or bulky object 18. In particular, the film 14 may accommodate an object 18 having a height exceeding a length and/or a width of the top surface 32 of the section 28 upon which the object 18 is loaded. In some instances, the film 14 may accommodate an object having a height exceeding twice a length and/or twice a width of the top surface 32 of the section 28 upon which the object 18 is loaded. The further the second section 30 is rotated, the tighter the film 14 is stretched across the object 18, and the stretched and tensioned film 14 extending over the object 18 prevents the object from sliding or shifting in the box 16 during transport. The second section 30 is folded until the bottom surface 37 of the second section 30 is disposed adjacent—and preferably in complete overlying abutment with—the bottom surface 36 of the first section 28 as shown in FIG. 5B. In this arrangement, the retention packaging 10 is disposed in the shipping configuration.

Furthermore, it should be noted that for the illustrated embodiment, wherein the first section 28 and the second section 30 are the same size, the receiving areas 46 of the film 14 and opposite ends 24 of the support member 12 are aligned when the retention packaging 10 is disposed in this shipping configuration. As such, the support member 12 provides a double layer of support for the object 18 placed thereon. Accordingly, the retention packaging 10 is able to accommodate relatively heavy objects for shipping and transport. Further, the torque applied to the film 14 when the retention packaging 10 is transitioned to the shipping configuration is a product of a lever arm that equals the length of the second section 30 and is approximately half the length of the support member 12.

It also is contemplated that the film 14 of the retention packaging 10 may further be heat shrunk prior to the retention packaging 10 being placed into the box 16 for shipment (provided that the film that is used is heat shrinkable). In this regard, the retention packaging 10 may be heat shrunk via a conventional heat shrinking tunnel or other conventional heat shrinking means.

To remove the large, tall, or bulky object 18 from the retention packaging 10, a person receiving the shipment merely removes the retention packing 10 and object 18 from the box 16 and then rotates the second section 30 away from its overlapping abutment with the first section 28. This relaxes and loosens the film 14, thereby permitting access to the retaining space 50 wherein the object 18 is held. The person then merely reaches into the retaining space 50, takes hold of the object 18, and removes it from the retention packaging 10.

The retention packaging 10 does not have to be damaged or torn in order to retrieve the object 18 therefrom. One merely pivots a support section about fold line 40 relative to the other support section to relax and loosen the film in order to remove the object 18 that was shipped therein. Further, the retention packaging 10 thereafter may be used again for shipment of a similarly shaped object. For reuse, either the original object 18 or an object having the same general shape and size as the original object 18 is placed in the retaining space 50 of the retention packaging 10. Then the retention packaging 10 is returned to the shipping configuration with the film 14 again conforming to the shape of the object, and the retention packaging 10 with the object retained therein is then placed in a box (possibly even the same box 16) for shipment. Furthermore, to the extent that the film 14 is initially stretched so as to retain a shape or memory of the original object 18, the object with which the retention packaging 10 is reused is positioned in the same orientation so as to correspond with and conform to such stretched area of the film 14.

Figure 6:
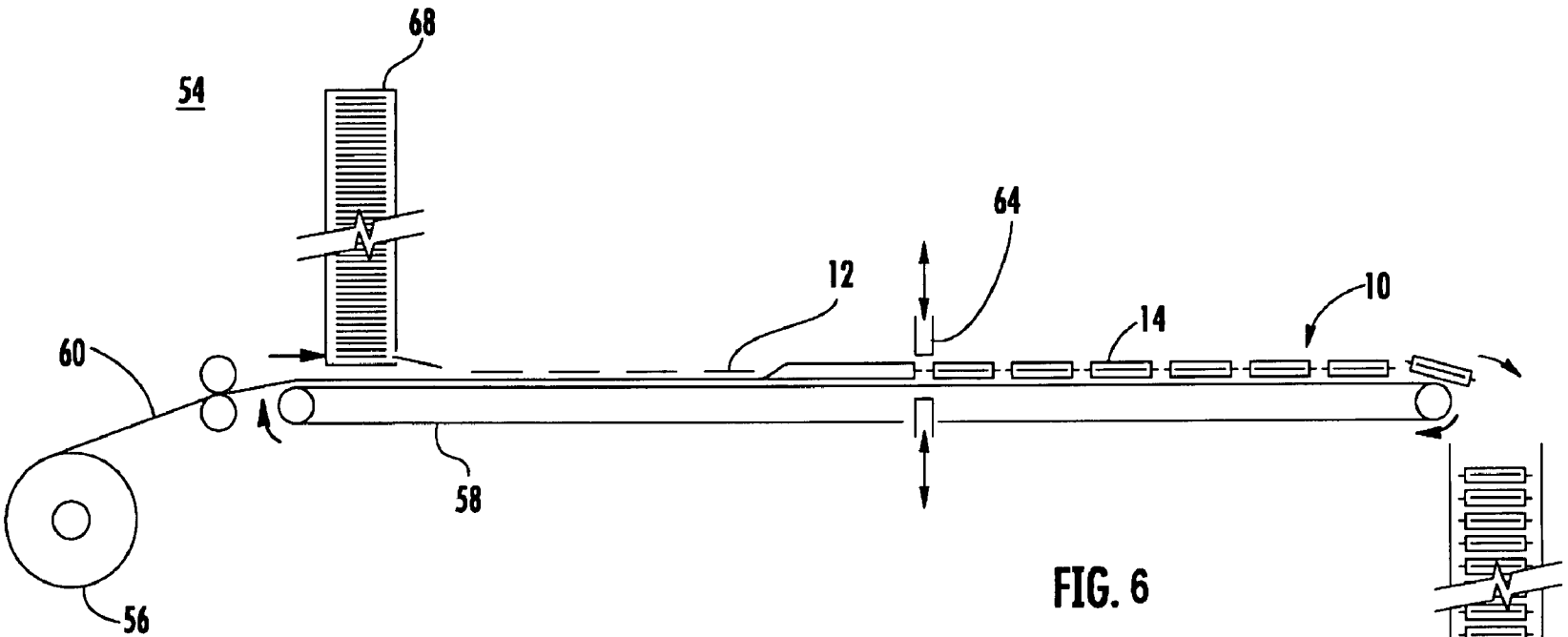
FIG. 6 is a schematic illustration, from a side point of view, representing a method and system of manufacturing preferred retention packaging of the present invention.
Figure 7:
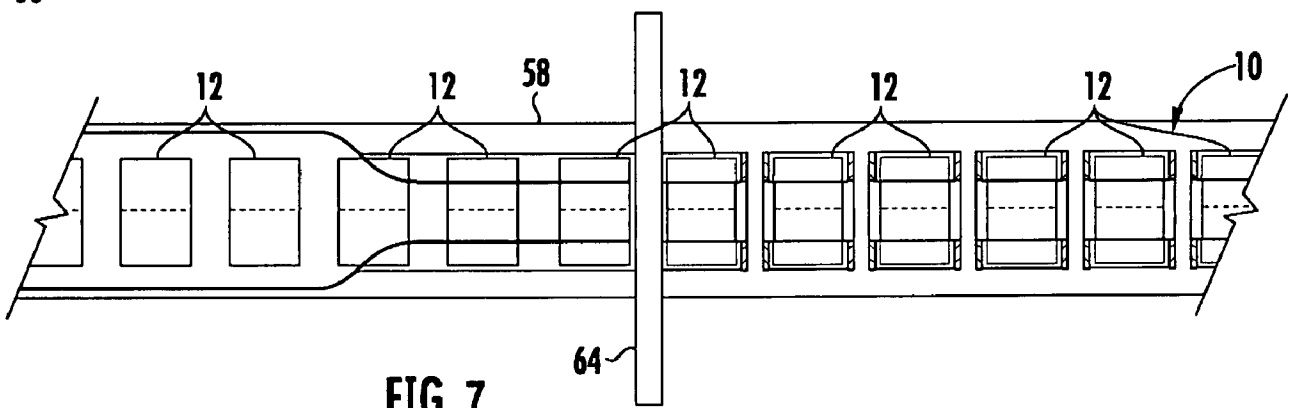
FIG. 7 is a schematic illustration, from a top point of view, representing a portion of the manufacturing method and system of FIG. 6.

FIGS. 6 and 7 illustrate the manufacturing method and system set forth in FIGS. 8 and 9 of U.S. patent application Ser. No. 11/941,061, which is referenced above and incorporated by reference herein. In particular, FIGS. 6 and 7 illustrate a preferred method and system 54 of manufacturing retention packaging 10. More particularly, FIG. 6 is a schematic illustration from a side point of view of the manufacturing method and system 54, and FIG. 7 is a schematic illustration from a top point of view of a portion of the manufacturing method and system 54.

In general, the manufacturing system 54 includes: a film supply roll 56; an endless conveyor belt 58 for conveying and supporting uncut film 60 as it is removed from the supply roll 56; an apparatus (not shown) both for folding opposite side edges of the film 60 around opposite side edges of the support members 12, and for folding opposite side edges of the film such that the film forms overlapping areas; and an apparatus 64 for sealing and cutting the film 60 to form permanent overlapping areas of the film 14. Furthermore, the cutting and sealing apparatus 64 may be one apparatus as shown or may be two separate apparatus. The manufacturing system 54 also includes a support member supply 68 that feeds pre-cut support members 12 onto the belt 58 supporting the film 60.

The manufacturing system 54 is arranged such that a pre-cut support member 12 is placed onto the film 60 as the film 60 is unrolled. A series of support members 12 are arranged along the conveyor belt on top of the film 60 with some incremental, predetermined space between each of the support members 12. The folding apparatus provides a folding surface that encourages opposite side edges of the film 60 to fold over on itself This results in the opposite side edges of the film 60 folding around opposite side edges of the support member 12 as well as folding over on itself to form overlapping areas of the film in the spacing between the support member 12. Then, while the folded side edges of the film 60 are maintained in said position, the cutting and sealing apparatus 64 seals and cuts the film 60 in between the support member 12 at adjacent leading and trailing edges of the support members 12. A retention packaging 10 is thereby formed after the overlapping areas of the film 14 have been sealed and cut on both the leading edge and then the trailing edge of a support member 12. The completed retention packaging 10 then continues on the conveyor belt 58 and is received in a supply container.

It further is noted that, during manufacturing, the film 14 is disposed below the support member 12 relative to the ground. Subsequently, for use, the finished retention packaging 10 is turned upside down such that the support member 12 is disposed below the film 14, in relation to the ground, for then receiving an object for shipment.

In addition to the above outlined steps in connection with the manufacturing method and system of the '061, application, a manufacturing method and system in accordance with the present invention may also include creating at least one fold in the film between the opposite end edges of the film and removably securing the film to itself so as to removably secure the at least one fold in the film. A pleated portion of the film is thereby defined, whereby an unfolded length of the film may exceed a distance between the opposite end edges of the support member. In particular, the folding step, whereby at least one fold is created in the film, may occur prior to the cutting and sealing step discussed above. More particularly, the folding step to create at least one fold of the pleated portion may occur simultaneously with the folding step discussed above in connection with folding side edges of the film over to form overlapping areas of the film. Additionally, at the cutting and sealing step, the cutting and sealing apparatus that cuts and seals the film may have a void area or a specially configured blade that permits the formation of integral tabs extending at either side of the cut film. As the apparatus cuts and seals the film, the apparatus may simultaneously seal the tabs together with a tack seal so as to removably secure the film to itself and thereby form the pleated portion.

FIG. 7 provides a more detailed view of the folding, cutting, and sealing process of the manufacturing system 54.

As is illustrated in FIG. 7, the support member 12 is positioned on the film 60 such that the film 60 extends beyond a leading edge of the support member 12, beyond a trailing edge of the support member 12, and beyond opposite side edges of the support member 12. As the belt 58 moves, opposite side edges of the film 60 are folded such that: the film 60 forms first overlapping areas beyond and proximate the leading edge of the support member 12; the opposite side edges of the film 60 are folded around the opposite side edges of the support member 12; and the film 60 forms second overlapping areas beyond and proximate the trailing edge of the support member 12. Such folding takes place for successive support members 12 as they progress along the conveyor belt 58.

After at least the first overlapping area is folded, the first overlapping area of the film 60 may be permanently joined together. The film 60 may also then be cut proximate the first overlapping area. Similarly, the second overlapping area of the film 60 may be permanently joined and then the film 60 may be cut proximate the second overlapping area. Typically, such sealing and cutting will occur between successive support members 12 so that sealing and cutting is occurring for a trailing edge of one support member 12 while simultaneously occurring for a leading edge of a following support member 12. After the film 14 is sealed and cut, it is retained to the support member 12 by the opposite side edges of the film 14 that are folded over opposite side edges of the support member 12 and the permanently joined overlapping areas of the film 14 that are beyond and proximate the leading and trailing edges of the support member 12.

In addition to the above outlined steps, the manufacturing process may also include scoring the support member 12 between opposite side edges of the support member 12 such that a score line 40 transects the support member 12 and defines first and second sections of the support member 12 that are pivotably connected to one another along the score line 40.

In addition to the above outlined steps in connection with the manufacturing method and system of the '061 application, a method of making first and second retention packagings via an assembly line in accordance with the present invention may also include forming a pleated portion in the film of each of the first and second retention packagings by creating at least one fold in the film between opposite side edges of the support member and removably securing the film to itself so as to removably secure the at least one fold in the film. In particular, the folding step, whereby at least one fold is created in the film, may occur prior to the cutting and sealing step discussed above.

More particularly, the folding step to create at least one fold of the pleated portion may occur simultaneously with the folding step discussed above in connection with folding side edges of the film over to form overlapping areas of the film for successive support members. Additionally, at the cutting and sealing step, the cutting and sealing apparatus that cuts and seals the film may have a void area or a specially configured blade that permits the formation of integral tabs extending at either side of the cut film. As the apparatus cuts and seals the film, the apparatus may simultaneously seal the tabs together with a tack seal so as to removably secure the film to itself and thereby form the pleated portion. Tabs may be formed and sealed together simultaneously at a trailing edge of one support member while simultaneously being formed and sealed together at a leading edge of a following support member.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A method of preparing a shipping container comprising:

(a) providing a retention packaging comprising:

(i) a support member having first and second sections each defining a support surface for receiving an object thereon for shipping, the first and second sections being pivotably connected to one another along a fold line that transects the support member; and (ii) a film disposed in covering relation to the support surfaces of the support member and retained to the support member at the first and second sections, the film including opposite ends each enclosing a respective opposite end of the support member and defining overlapping areas of the film that are permanently joined together, with the first section of the support member extending between the overlapping areas of one of the opposite ends of the film, and with the second section of the support member extending between the overlapping areas of the other of the opposite ends of the film;

(iii) wherein, (A) each opposite end of the support member includes a respective opposite end edge of the support member, the opposite end edges of the support member being spaced a distance apart when the first and second sections are coplanar, (B) the film further comprises a pleated portion that is located between the opposite ends of the film and that includes at least one fold in the film, the film being removably secured to itself so as to removably secure the at least one fold of the pleated portion, and (C) the film further comprises a plurality of tabs located along a side edge of the film and spaced to substantially coincide with one another by virtue of the at least one fold in the film, wherein the tabs are removably attached to one another to removably secure the at least one fold of the pleated portion, (b) separating the tabs from one another so as to unsecure the at least one fold and thereby open the pleated portion of the film;

(c) placing an object on the support surface of a selected one of the first and second sections of the support member such that the film extends over the object;

(d) pivoting one of the sections relative to the other section about the fold line so that the first and second sections of the support member are disposed in substantially overlapping, abutting relation to one another such that the film tensions the object in abutment with the selected support surface; and (e) placing the retention packaging into an interior cargo space of the shipping container.

2. The method of claim 1, wherein a height of the object from the selected support surface exceeds both a length and a width of the support surface of the selected section.

3. The method of claim 2, wherein the height of the object from the selected support surface exceeds twice the length and twice the width of the support surface of the selected section.

4. The method of claim 1, wherein the fold line generally bisects the support member.

5. The method of claim 1, wherein the first and second sections of the support member are approximately equal in length and width.

6. The method of claim 1, wherein the first and second sections of the support member have approximately equal surface area.

7. The method of claim 1, wherein the overlapping areas of the film that are permanently joined together are heat sealed, adhered, or welded together.

8. The method of claim 1, wherein the film comprises a stretchable material.

9. The method of claim 1, wherein the film comprises a heat shrinkable material.

10. The method of claim 1, wherein the support member is scored along the fold line.

11. A method of making a retention packaging, comprising:

(a) positioning both a film and a support member such that the film extends, (i) in covering relation to a surface of the support member, (ii) beyond a first side edge of the support member, (iii) beyond a second side edge of the support member, and (iv) beyond opposite end edges of the support member;

(b) folding opposite end edges of the film such that the film forms first overlapping areas beyond and proximate the first side edge of the support member at the opposite end edges of the support member, and forms second overlapping areas beyond and proximate the second side edge of the support member at the opposite end edges of the support member; and (c) permanently joining the first overlapping areas of the film together and permanently joining the second overlapping areas of the film together; and (d) further comprising creating at least one fold in the film between the opposite end edges of the film and removably securing the film to itself by removably attaching one or more tabs of the film to one another so as to removably secure the at least one fold in the film, thereby defining a pleated portion of the film, whereby an unfolded length of the film may exceed a distance between the opposite end edges of the support member;

(e) wherein the film with the pleated portion is retained to the support member by the opposite end edges of the film that are folded over the opposite end edges of the support member and the permanently joined overlapping areas of the film that are beyond and proximate the first and second side edges of the support member.

12. The method of claim 11, further comprising cutting the film proximate the first overlapping areas and proximate the second overlapping areas.

13. The method of claim 11, wherein the support member has first and second sections pivotably connected to one another along a fold line that transects the support member.

14. The method of claim 13, wherein the first and second sections of the support member are approximately equal in length and width.

15. The method of claim 13, wherein the first and second sections of the support member have approximately equal surface area.

16. The method of claim 13, wherein the support member is scored along the fold line.

17. The method of claim 13, wherein the fold line generally bisects the support member.

18. The method of claim 11, wherein the film comprises a stretchable material.

19. The method of claim 11, wherein the film comprises a heat shrinkable material.

20. A method of making first and second retention packagings via an assembly line, comprising:

(a) for each of the first and second retention packagings, (i) positioning both a film and a support member such that the film extends, (A) in covering relation to a surface of the support member, (B) beyond a leading edge of the support member, (C) beyond a trailing edge of the support member, and (D) beyond opposite side edges of the support member;

(ii) folding opposite side edges of the film such that the film forms first overlapping areas proximate and beyond the leading edge of the support member, (iii) permanently joining the first overlapping areas of the film together, (iv) cutting the film proximate the first overlapping areas, (v) folding opposite side edges of the film such that the film forms second overlapping areas proximate and beyond the trailing edge of the support member, (vi) permanently joining the second overlapping areas of the film together, and (vii) cutting the film proximate the second overlapping areas, (viii) wherein the film is retained to the support member by opposite side edges of the film that are folded over the opposite side edges of the support member and the permanently joined overlapping areas of the film that are proximate and beyond the leading and trailing edges of the support member;

(b) wherein step (vii) of cutting the film at the second overlapping areas with regard to the first retention packaging is performed concurrently with step (iv) of cutting the film at the first overlapping areas with regard to the second retention packaging; and (c) further comprising forming a pleated portion in the film of each of the first and second retention packagings by creating at least one fold in the film between opposite side edges of the support member and removably securing the film to itself by removably attaching one or more tabs of the film to one another so as to removably secure the at least one fold in the film.

* * * * *